US007467481B2

(12) United States Patent
Christian

(10) Patent No.: US 7,467,481 B2
(45) Date of Patent: Dec. 23, 2008

(54) RACK SYSTEM FOR STORING, DRYING, AND DEODORIZING BOOTS

(76) Inventor: Star L. Christian, 2921 Oakland Hills Dr., Plano, TX (US) 75025

( * ) Notice: Subject to any disclaimer, the term of this patent is extended or adjusted under 35 U.S.C. 154(b) by 346 days.

(21) Appl. No.: 11/502,818

(22) Filed: Aug. 14, 2006

(65) Prior Publication Data

US 2007/0044340 A1 Mar. 1, 2007

Related U.S. Application Data

(60) Provisional application No. 60/711,165, filed on Aug. 26, 2005.

(51) Int. Cl.
*F26B 25/00* (2006.01)
*A01F 25/12* (2006.01)

(52) U.S. Cl. ..... 34/104; 34/239

(58) Field of Classification Search ..... 34/104, 34/239, 437; 211/34, 37, 38, 182
See application file for complete search history.

(56) References Cited

U.S. PATENT DOCUMENTS

| | | | | |
|---|---|---|---|---|
| 3,747,774 | A | 7/1973 | Kulik | |
| 4,798,933 | A | 1/1989 | Annovi | |
| 5,199,188 | A * | 4/1993 | Franz | 34/104 |
| 5,222,308 | A * | 6/1993 | Barker et al. | 34/104 |
| 5,377,849 | A * | 1/1995 | Martin | 211/182 |
| 5,469,635 | A * | 11/1995 | Lamontagne et al. | 34/104 |
| 5,592,750 | A * | 1/1997 | Eichten | 34/104 |
| 6,119,871 | A | 9/2000 | Mengel | |
| 6,464,087 | B1 | 10/2002 | Klein et al. | |
| 6,502,707 | B1 | 1/2003 | Sullivan | |
| D470,338 | S | 2/2003 | Licari | |
| 6,796,053 | B2 * | 9/2004 | Lurie | 34/104 |
| 2005/0204579 | A1 * | 9/2005 | Rosseau et al. | 34/104 |

OTHER PUBLICATIONS

"Foot Smart" Catalog Page; Norcross, GA, USA; (copy submitted).
"Harmony" Catalog Page; p. 66; USA; (copy submitted).
Catalog Page; p. 23; author unknown; www.alsto.com; (copy submitted).

* cited by examiner

*Primary Examiner*—Jiping Lu
(74) *Attorney, Agent, or Firm*—Ronald B. Sefrna

(57) ABSTRACT

A boot rack system for storing boots in an inverted orientation on a rotatable carousel and for drying and deodorizing boots includes, in the preferred embodiment, a base enclosing a blower, a heating unit, and a deodorizing unit, a hollow primary support and duct tube extending upwardly from the base, a boot carousel with a hub received over the upper end of-the primary support and duct tube, a plurality of hollow spokes extending outwardly from the hub, and a boot support connected to the outer end of each spoke. Air is forced by the blower through the selectively operable heating unit and ionizing unit, the primary support and duct tube, the spokes, and the boot supports and into the interior of boots placed on the boot supports. Additional boot carousels may be added, supported on extension tubes extending upwardly from the hub of the next lower carousel.

25 Claims, 10 Drawing Sheets

RACK SYSTEM FOR STORING, DRYING, AND DEODORIZING BOOTS

RELATED APPLICATION DATA

This application claims the benefit of U.S. Provisional Patent Application Ser. No. 60/711,165, filed Aug. 26, 2005, titled "Rack System For Storing, Drying, and Deodorizing Boots".

FIELD OF THE INVENTION

The present invention generally relates to devices for the storage of shoes and boots, and in its preferred embodiments more specifically relates to an apparatus for the efficient storage of boots that provides a means for selectively drying and deodorizing boots stored on the apparatus.

BACKGROUND

Boots are very popular items of footwear, and it is not uncommon for a person to accumulate several pair of boots, which must be stored when they are not being worn. Storage of boots can be much more problematic than storage of shoes, because boots take up a significantly larger space than shoes and because boot uppers or tops are often flexible and have a tendency to collapse when the boots are not being worn. Typical racks and other systems for efficient and space saving storage of shoes are not designed for and are not suitable for the storage of boots. As a result, many boot owners store them on a closet floor, where they are more subject to damage, or store them in their original boxes, which are bulky and makes access to the boots inconvenient.

Boots are often worn in inclement weather and during the winter season, and often become wet from rain or snow. Boots, like other footwear, can also become damp from foot perspiration and can accumulate odors. It is desirable, therefore, for boots to be allowed to dry and air before they are worn again. Boots are much more difficult to dry than shoes, because of their larger size but especially because the structure of a boot limits the circulation of air within the boot. Boots with flexible tops that fold over when the boots are not being worn can be particularly troublesome to dry because the folded over top completely eliminates air circulation to the interior of the boot. As a result of the limited air circulation boots generally dry more slowly than shoes, and can more easily develop a musty, unpleasant odor.

Devices for storing boots are known in the prior art, but these devices do not provide a means for drying the boots. Accordingly, it is necessary to employ some means of drying and airing the boots before they are stored. Devices for drying boots are also known in the prior art. Typically, the prior art devices utilize warm air for drying, either by hanging the boots over a heating vent or in some instances by forcing warmed air into the boots. When dry the boots must be removed from the drying device and moved to another location for storage. When the drying devices of the prior art are not being used they simply take up space, and these devices are often unattractive as well.

SUMMARY OF THE INVENTION

The present invention addresses and overcomes the deficiencies of the prior art by providing a storage rack specifically for the storage of boots, with interchangeable components to accommodate boots of different heights to maximize storage efficiency. The storage rack of the invention also includes an integral drying system to selectively circulate gently warmed drying air through the interior of the boots to safely dry the boots on the same rack used for storage. It is unlikely that all boots stored on the rack will require drying at the same time, and circulating heated drying air to boots that do not require it can result in damage to the boots. To avoid the potential problems associated with excessive drying, the rack of the invention includes a means of directing air to a selected storage position or positions on the rack, so that only those boots that will benefit from the circulation of drying air will receive it.

In the preferred embodiment the rack of the invention also includes a means of ionizing the circulating warmed air, providing a deodorizing effect in addition to drying. Unheated air may also be supplied to some or all of the storage positions on the rack of the invention, with or without ionization, to gently remove the slight dampness and odors that accumulate when boots are worn even in dry weather.

The structure and features of the boot storage, drying, and deodorizing device of the invention will be described in more detail with reference to the accompanying drawing figures.

DESCRIPTION OF THE INVENTION

Figure 1:
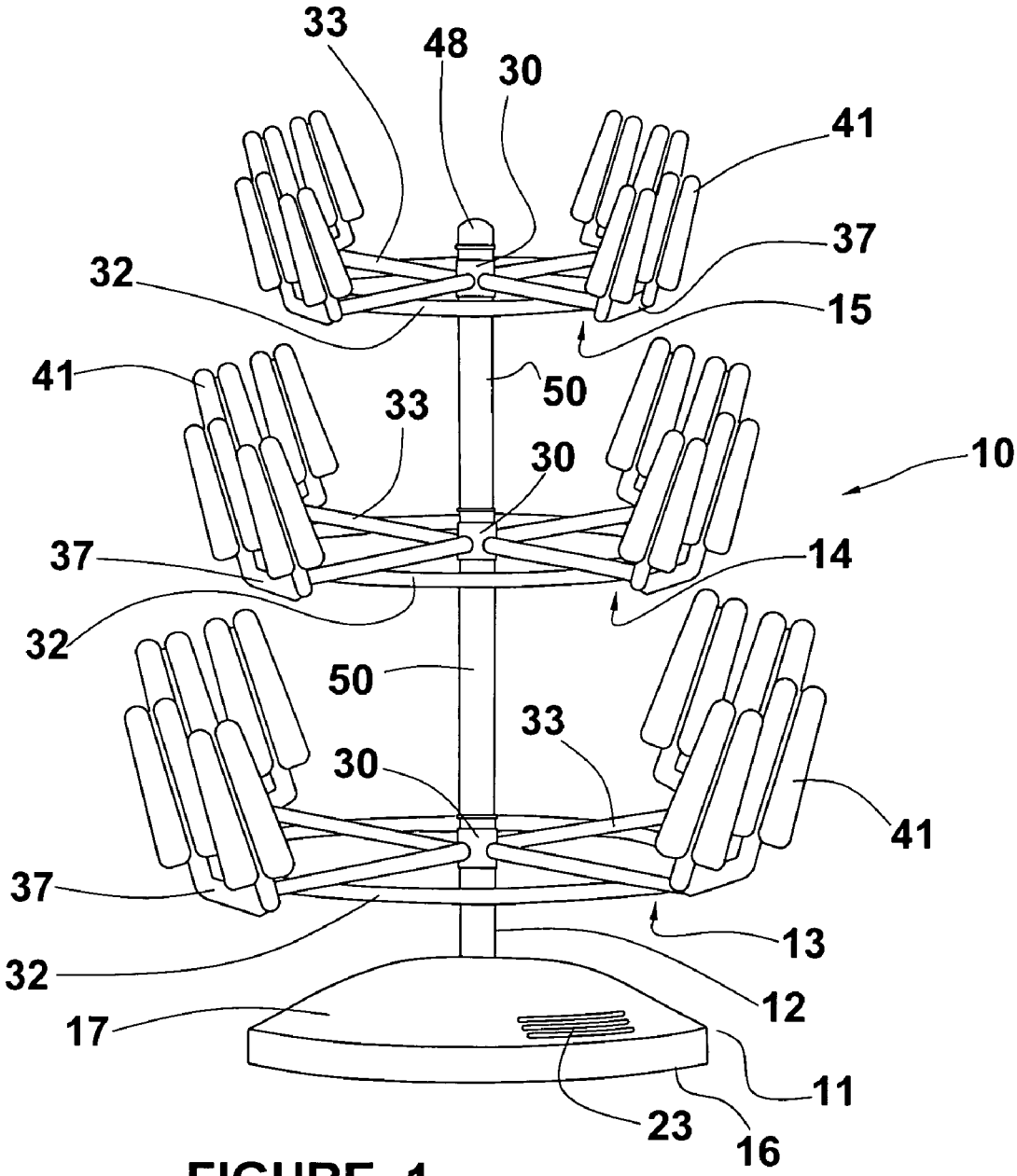
FIG. 1 is a side elevation view of a preferred embodiment of the boot storage, drying, and deodorizing rack of the invention.
Figure 2:
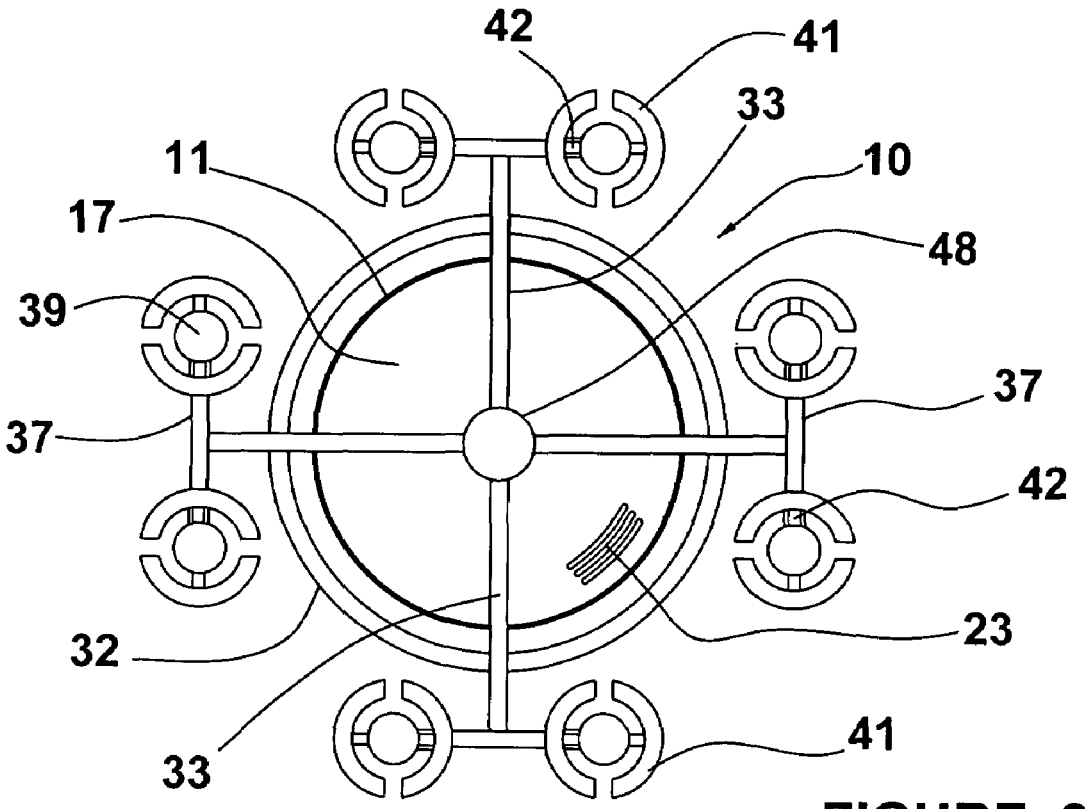
FIG. 2 is a top plan view of a preferred embodiment of the rack of the invention, showing one carousel.
Figure 3:
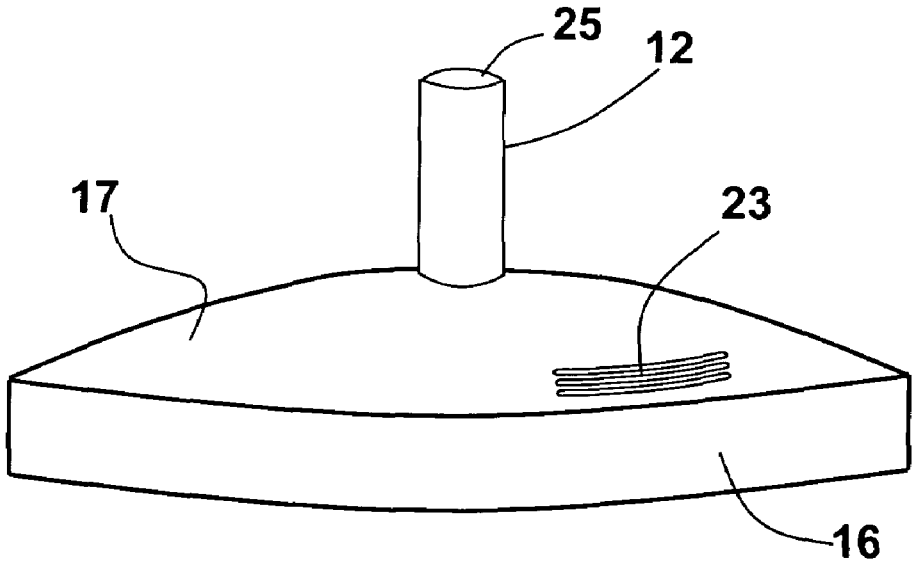
FIG. 3 is a side elevation view of the base component, with primary support and duct tube.
Figure 4:
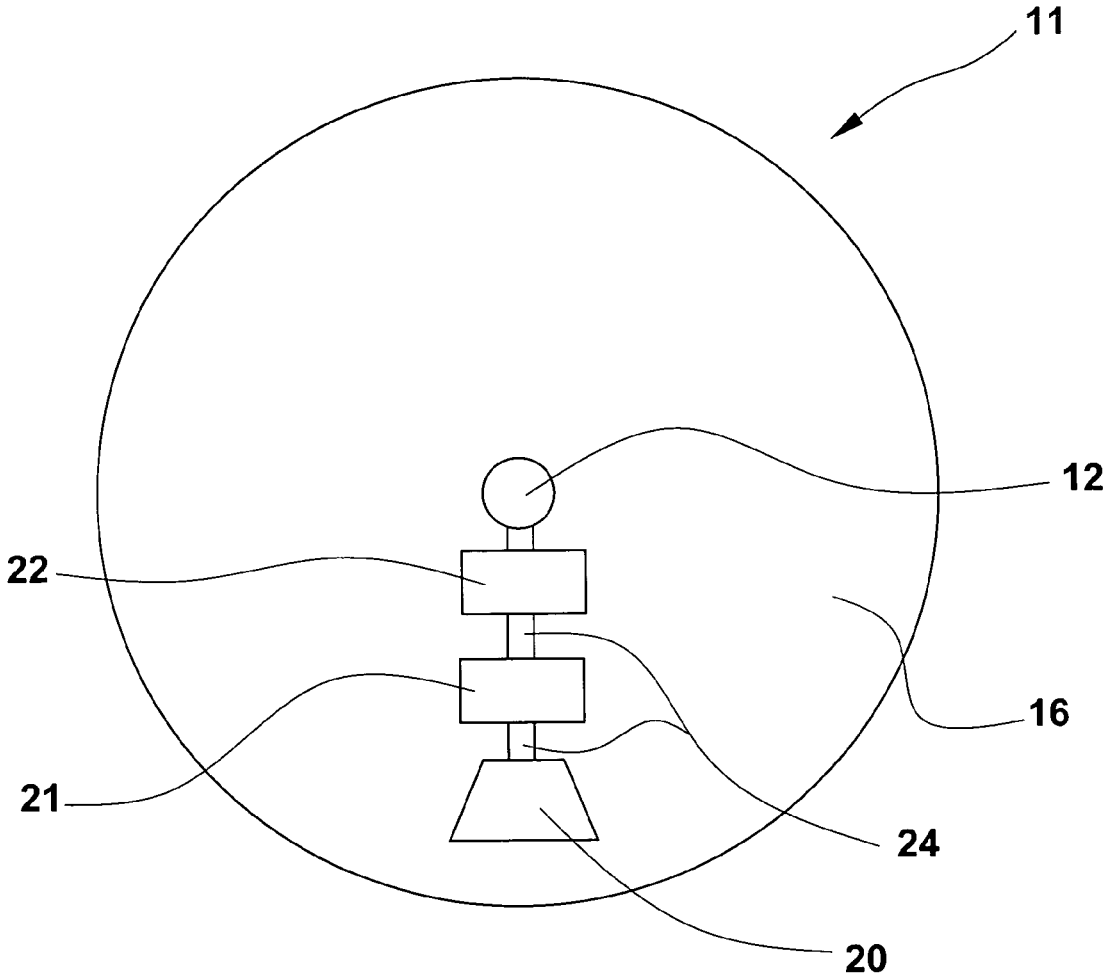
FIG. 4 is a top plan view of the base component, with the housing removed, schematically showing a blower, heating unit, and ionizing unit, and a connecting air duct.
Figure 5:
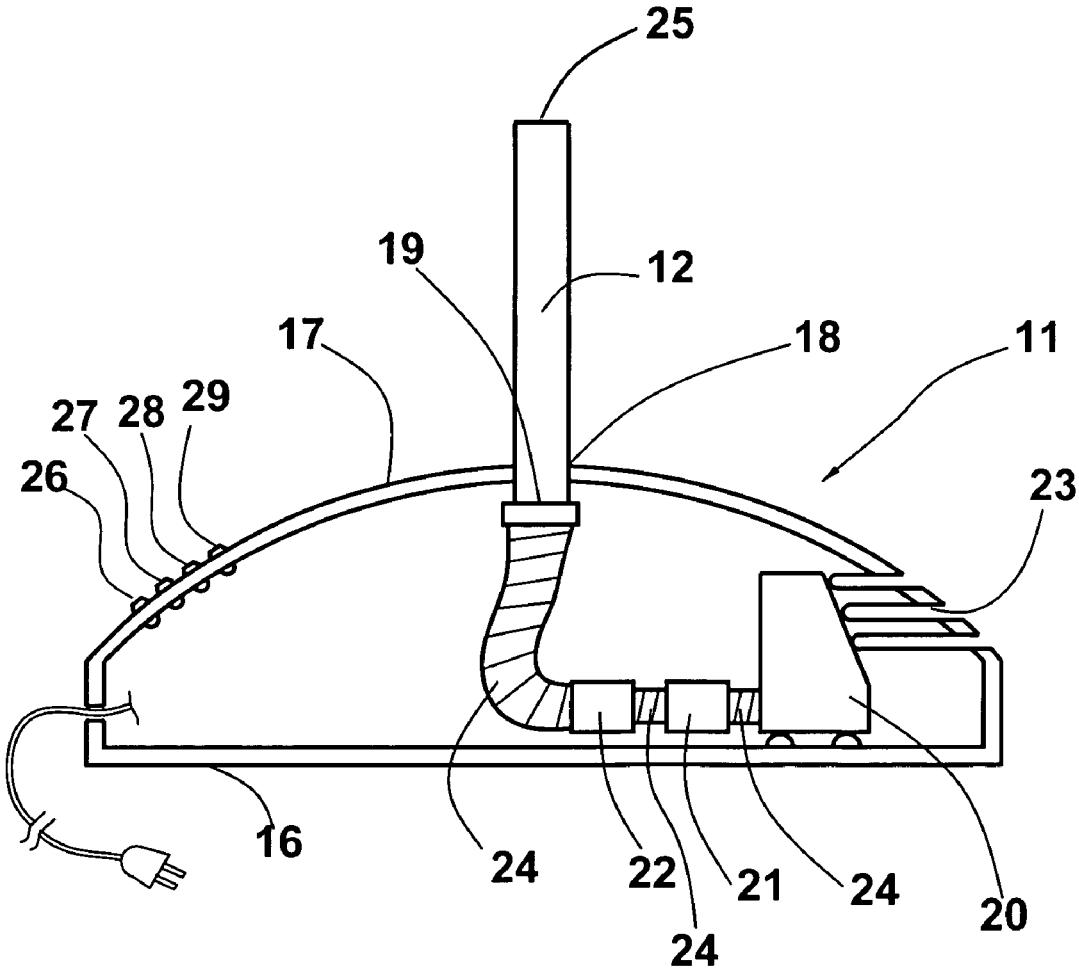
FIG. 5 is a sectioned side elevation view of the base component, with primary support and duct tube, schematically showing a blower, heating unit, and ionizing unit, with air duct, in an embodiment with a cord to be connected to a source of electrical power.
Figure 6:
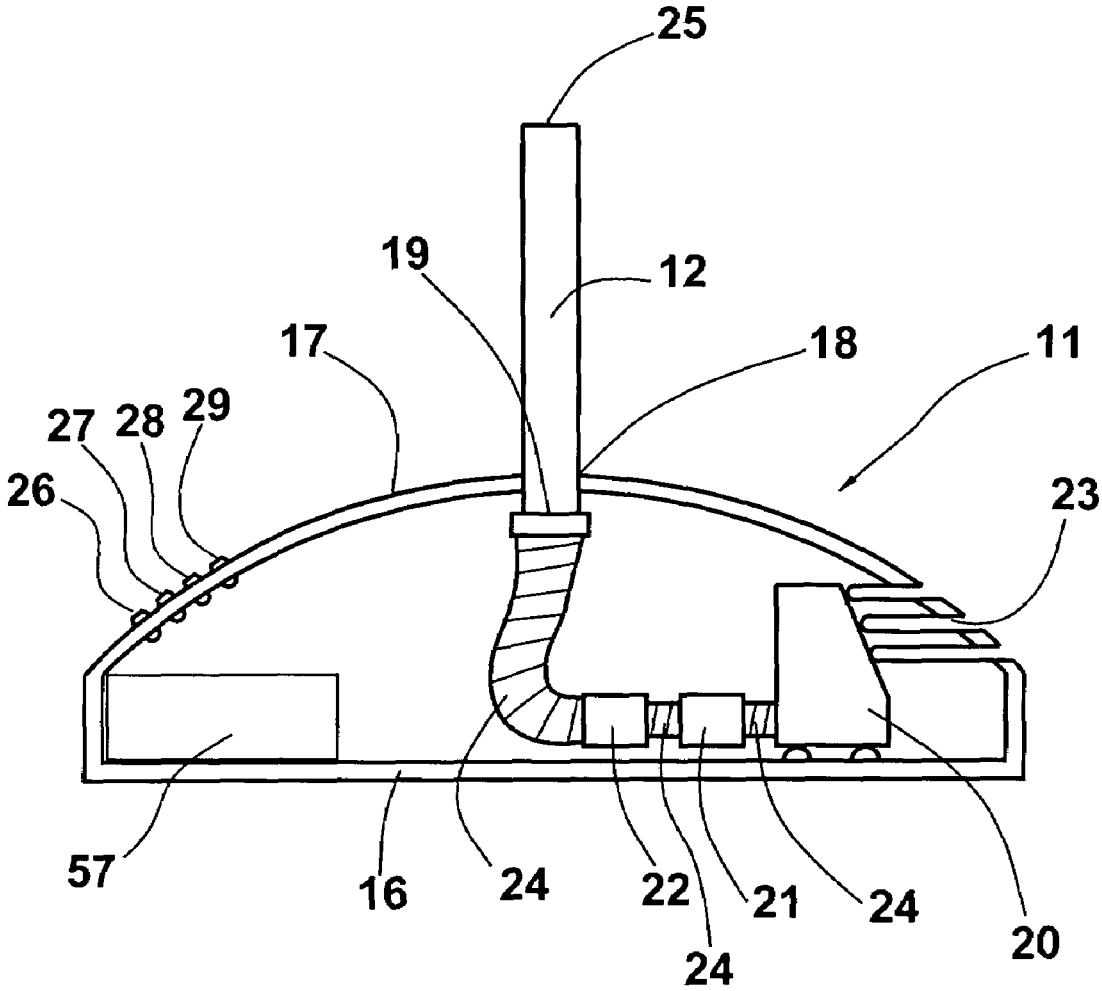
FIG. 6 is a sectioned side elevation view of an alternative embodiment of the base component, as in FIG. 5, with a battery pack for providing electrical power.
Figure 7:
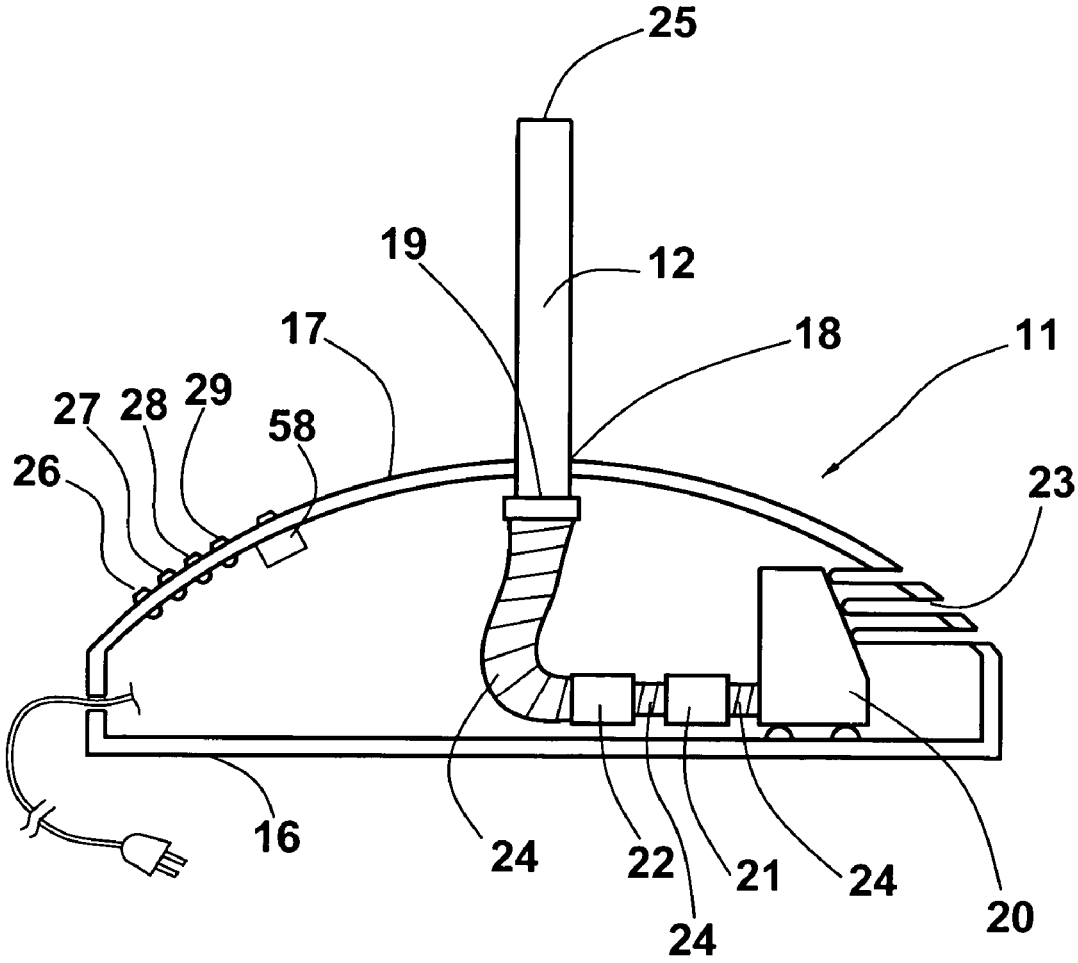
FIG. 7 is a sectioned side elevation view of an alternative embodiment of the base component, as in FIG. 5, with a timer for controlling the duration of activation of electrical components.
Figure 8:
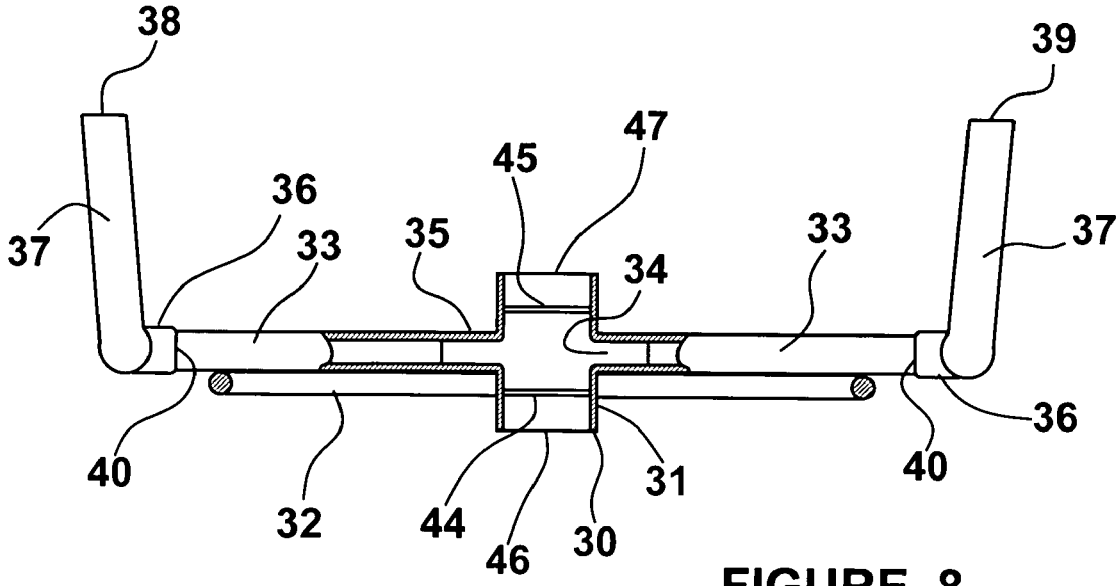
FIG. 8 is a sectioned side elevation view of a carousel component.
Figure 9:
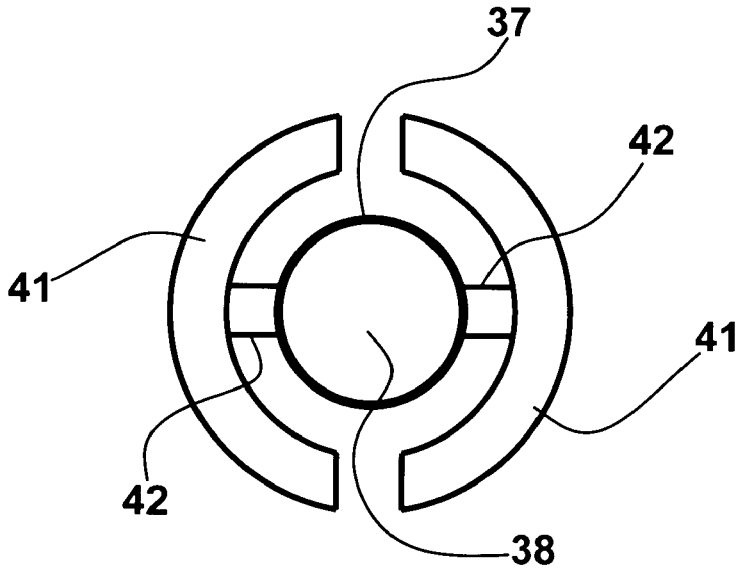
FIG. 9 is a top plan view of one leg of a boot support component, with boot pads.
Figure 10:
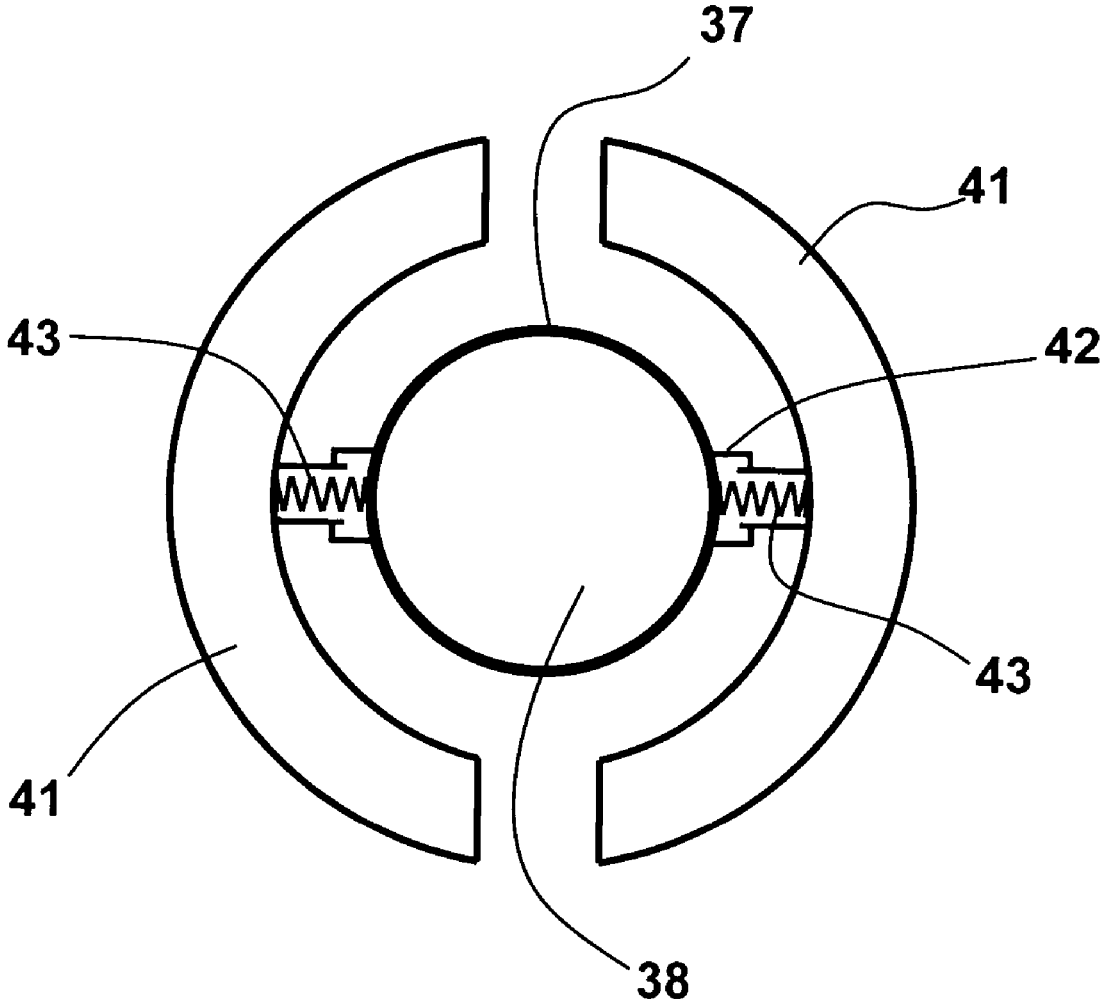
FIG. 10 is a partially sectioned top plan view of a boot support component, with boot pads, as in FIG. 9
Figure 11:
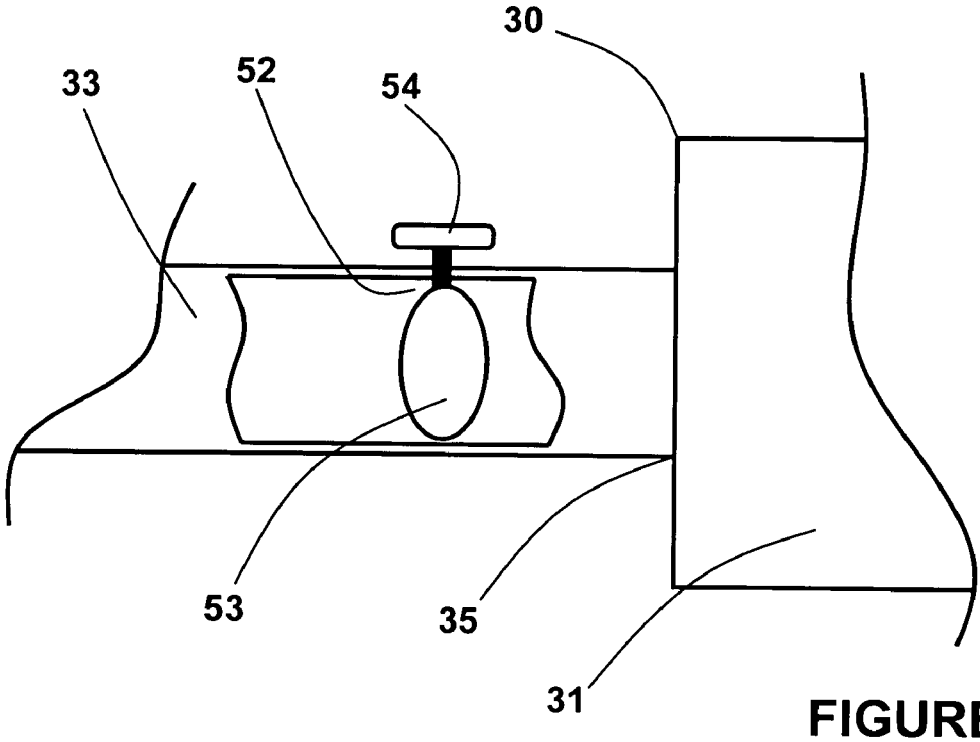
FIG. 11 is a partial, sectioned side elevation view of a portion of a carousel hub and spoke, with an air control valve installed.
Figure 12:
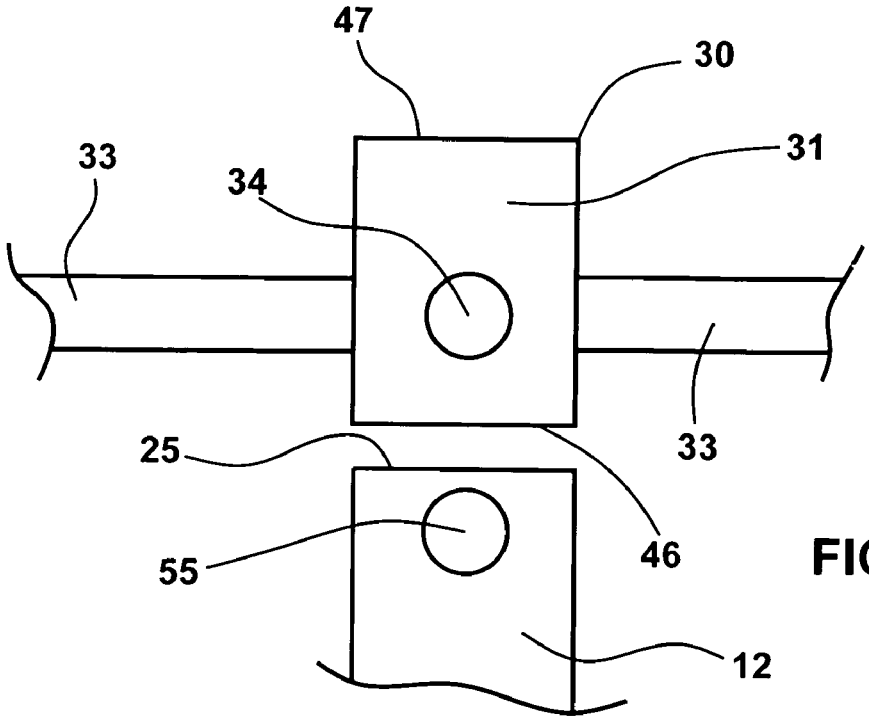
FIG. 12 is a partial side elevation view of an alternative embodiment of a carousel hub and spokes, and of the upper end of an alternative embodiment of the primary support and duct tube, illustrating another means for air flow control.
Figure 13:
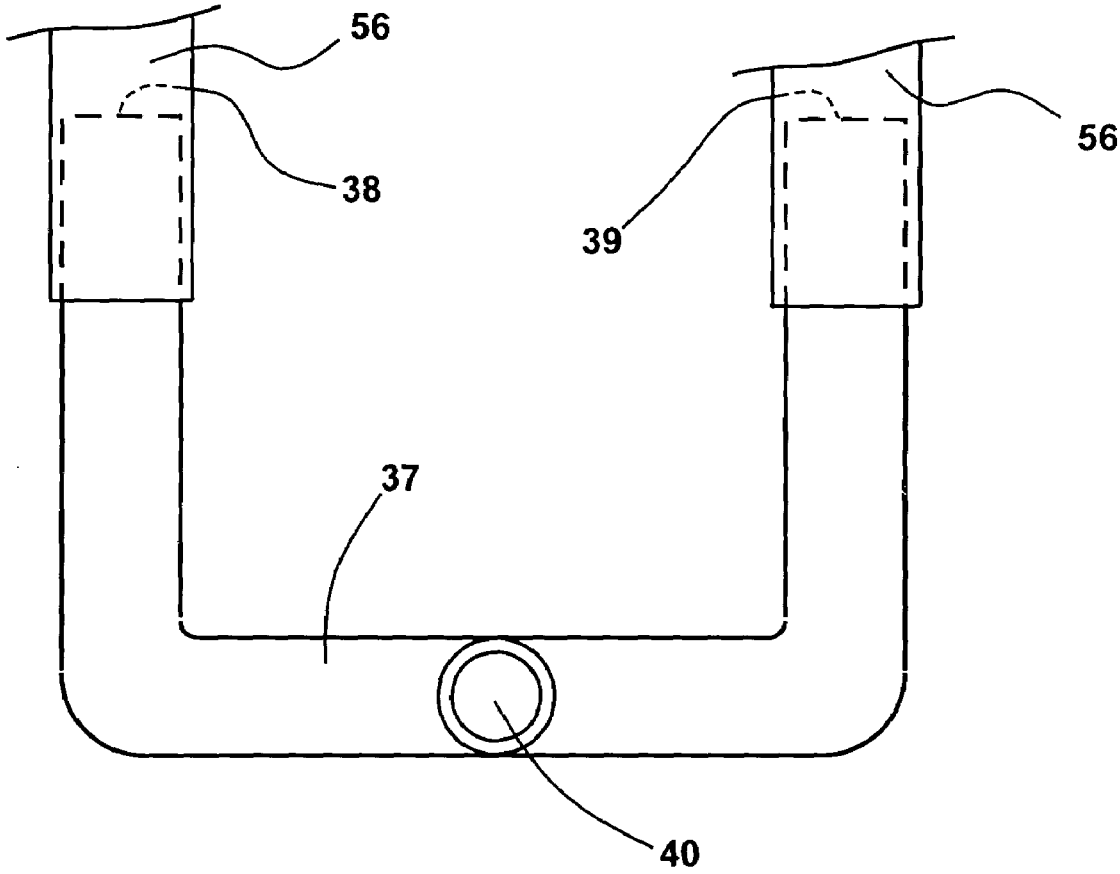
FIG. 13 is an elevation view of an alternative embodiment of the boot support component, with telescoping end tubes.

In its preferred embodiments the rack of the invention, generally identified by reference number 10, includes a base 11 to be placed on a floor or other generally horizontal supporting surface, a hollow open ended primary support and duct tube 12 interconnected to base 11 and extending upwardly therefrom, and a plurality of interchangeable storage carousels to be connected to tube 12. In the embodiment illustrated in the drawings, e.g., FIG. 1, the rack 10 includes three carousels, 13, 14, and 15, but the number of carousels is not critical within the scope of the invention and it is to be understood that the number may range from one to any number that may be reasonably supported on the base and will fit within the height of the space available for storage.

In the preferred embodiment, base 11 is formed as a hollow body with a flat bottom wall 16 and an upper housing 17, defining the hollow interior. A smoothly curved domed housing is preferred, generally for an aesthetic appearance, but it is to be understood that any structure or configuration for base 11 that provides stability to the rack and accommodates components for heating and circulating air as described below may be used within the scope of the invention. Housing 17 is penetrated by a central aperture 18 to receive the first or lower end 19 of primary tube 12. Primary tube 12 is securely connected to base 11 by any convenient means, while providing a passageway into the hollow interior of tube 12 at or adjacent to its lower end 19.

A fan or blower 20, a heating unit 21, and in the preferred embodiment an ionizing unit 22 are disposed in base 11, and connected in air flow communication with the interior of primary tube 12. The blower, heating unit, and ionizing unit are electrically powered, preferably from a convenient source of household electrical power. Blower 20 is preferably of variable speed or multiple speed so that the volume of air moved by the blower can be selected and controlled by the user. The specific construction of blower 20 is not critical to the invention, and any conventional, compact blower may be used. Heating unit 21 is preferably an electrical resistance type heating unit, and, like blower 20, may be of any conventional compact design. The capacity of heating unit 21 is sufficient to raise the temperature of the volume of air moved across the, e.g. heating coils to a temperature suitable for drying boots, with the temperature of the air leaving the heating unit preferably no higher than the temperature generated by a typical hand held hair dryer. Excessive heat can be damaging to leather and other materials used in boot construction, and the heating unit should be selected so that the temperature of the air delivered to the boots be within the appropriate range for safely drying the boots without damage. It is preferred, though not essential to the invention, that heating unit 21 be of at least a two stage type, with a "high" setting and a "low" setting, so that a user may select the heating level when the heating unit is activated, in addition to an "off" setting in which the heating unit is deactivated and unheated air may be circulated by blower 20. Ionizing unit 22 is a conventional type negative ion generator. Air is drawn into base 11 through slots 23 in housing 17, or though other openings in the base structure that allow a sufficient flow of incoming air, and is moved by blower 20 through heating unit 21 and ionizing unit 22, and is then routed through duct 24 to the hollow interior of primary tube 12 at or adjacent to lower end 19. The air is forced by the blower upward through the interior of tube 12 to its upper end 25.

The operations of the blower, heating unit, and ionizing unit are controlled by switches mounted in housing 17. In the preferred embodiment the controls include a blower switch 26, a heating unit switch 27, and an ionizing unit switch 28. As noted above, it is preferred that the blower and the heating unit be operable at variable speeds and heat settings, and the respective switches controlling those units provide appropriate variable settings. The control for the ionizing unit may be a simple "on-off" switch. It is also preferred, though not required within the scope of the invention, that a master switch 29 be provided, to activate and deactivate the circuit supplying power to all three of the described units, so that a user may predetermine preferred settings and use the master switch to turn the system on and off.

The independently operable switches of the preferred embodiment allow the system to be operated in a variety of different modes, allowing the user to select the degree of heating provided, the blower speed, with or without heating, and the operation of the ionizing unit, with or without heating. The system may also be operated in a convection mode, with the blower deactivated and the heating unit activated at a low setting. Air heated by the heating unit will rise and be carried to the interior of boots placed on the rack by natural convection.

At least one carousel, such as carousel 13, is mounted on the upper end 25 of primary tube 12, to provide storage for boots and to establish a passageway for the flow of air from primary tube 12 to the boots. Each carousel includes a center hub 30 formed as a short open ended hollow cylindrical body with a surrounding side wall 31. A stabilizing ring 32 is disposed concentric with the hub 30 and is connected to the hub by a plurality of hollow spokes 33 that extend outwardly from the hub to the stabilizing ring and a short distance outwardly beyond the stabilizing ring. Hub 30 includes a plurality of apertures 34 disposed around the circumference of the hub and penetrating the cylindrical wall. The number of apertures 34 is equal to the number of spokes 33. In the preferred embodiment the number of spokes and apertures in each carousel is four, but it will be understood that either more or fewer may be used so long as adequate space is provided between them to allow for the storage of boots. Each spoke 33 is connected at its inner end 35 to hub 30 around one of apertures 34 so that the hollow interior of each spoke is in air flow communication with the hollow interior of the hub. Bracing between the inner portion of each spoke and the hub may be provided as needed, to assure that each spoke will support the weight of a pair of boots. The stabilizing ring 32 is connected to each of the spokes between outer end 36 and inner end 35 of each spoke, in a manner that does not compromise or close the air flow passageway through each spoke. As non-limiting examples, the stabilizing ring may be connected to the outer surface of the spokes, or the spokes may extend through apertures formed in the stabilizing ring. Although the use of stabilizing ring 32 is preferred to stabilize spokes 33, in an alternative embodiment stabilizing ring 32 may be omitted, with each spoke 33 extending outwardly from hub 30 independently of each other, and without connection to each other at their outer ends.

A U-shaped boot support 37 is connected to outer end 36 of each spoke 33, with the legs of the U extending generally upwardly at an angle relative to the spoke. Each boot support is formed as a hollow tube with an open first end 38 and an open second end 39. The connection between the boot support and the spoke is made at the midpoint of the U, with the outer end of the spoke connected to the boot support around an aperture 40 in the boot support to establish an air flow passageway from the interior of the spoke to the interior of the boot support.

In the preferred embodiment, a pair of boot pads 41 is connected in opposed relation to each leg of the U-shaped boot support 37, to be received in the interior of the upper or leg of a boot to support the boot in an inverted orientation over and above the boot pads and respective leg of the boot support. Each pad 41 is connected to the leg of the boot support by a mounting rod 42. In the preferred embodiment mounting rods 42 are formed as a two-part telescoping mounting rod, with a biasing means such as coil spring 43 disposed in the interior of the mounting rod to provide a light outwardly directed spring bias to the boot pads. A resilient insert could be used as a biasing means as an alternative to coil spring 43. When a boot is placed over the boot pads on the rack of the invention the spring bias presses the boot pads against the leg of the boot from the inside of the boot to maintain the shape of the boot, and to suspend the boot with the inner sole a short distance away from the open end of the respective leg of boot support 37. Alternatively, mounting rods 42 may be formed as solid structures and boot pads 41 formed of a resilient material that will compress when a boot is placed over the pads to provide the desired support for the leg of the boot.

The inside diameter of hub 30 is slightly larger than the outside diameter of primary tube 12 at its upper end 25, and carousel 13 is connected to primary tube 12 by placing the carousel over the base and primary tube with the upper end of the primary tube received in the interior of the hub. Annular lower ledge 44 and upper ledge 45 are preferably formed in the interior of hub 30 inward from the first or lower end 46 and the second or upper end 47, respectively, of the hub. Lower ledge 44 is received against the upper end 25 of primary tube 12 to support the carousel on the primary tube and allow the carousel to rotate around the primary tube. When carousel 13 is placed on primary tube 12 an air flow passageway is established from base 11, through primary tube 12, hub 30, spokes 33, and boot supports 37, so that air forced into tube 12 by blower 20 will flow through the interior of the structure and exit from the open ends of each boot support 37 into the interior of a boot suspended on the boot support structure.

If a single carousel, e.g., carousel 13, is to be utilized, providing a single level of boot storage, a cap 48 is removably connected to the upper end of hub 30, to close the hub and prevent air from flowing from primary tube through the upper end of the hub. However, if a second carousel, e.g., carousel 14, is to be used in addition to carousel 13, the first end 49 of an extension tube 50 is inserted into the upper end of hub 30 of carousel 13, and the hub 30 of carousel 14 is placed on the second, upper end 51 of extension tube 50. Cap 48 is then connected to the hub of carousel 14. An additional carousel 15 may be added to the structure, using a second extension tube 50, in the same manner.

With the structure described above, when blower 20 is activated air is forced through the interior of the entire structure and from each boot support 37, regardless of whether boots are in place on each boot support, and regardless of whether all the boots stored on the rack require drying or airing. It is desirable, and preferred, that the air flow be controllable, so that a user may select which pair, or pairs, of boots will receive air and so that air flow from unoccupied boot supports may be prevented. Several means may be used within the scope of the invention to achieve this purpose. In the preferred approach, an air control valve 52 is disposed in each spoke 33, so that each spoke may be opened or closed to the flow of air through the spoke and from the connected boot support. Because the air pressure produced by blower 20 is relatively low, a simple butterfly valve with a disk 53 pivotally mounted in the interior of each spoke and an exterior handle 54 to control the position of the disk is sufficient to control the air flow.

In an alternative approach, air flow to each carousel may be controlled. In this embodiment, a plurality of apertures 55 are formed in primary tube 12 adjacent to upper end 25. The number of apertures 55 is equal to the number of spokes 33 of carousel 13 and the apertures are disposed to align with apertures 34 in hub 30 when carousel 13 is placed on primary tube 12. In this embodiment primary tube 12 extends farther into hub 30 of carousel 13 so that apertures 34 and 55 may be brought into alignment. The carousel 13 may be rotated, rotating hub 30 on primary tube 12, to align apertures 34 with apertures 55 and allow air flow into the associated spokes and through boot supports 37 of that carousel, or to offset apertures 34 from apertures 55 to prevent air flow. Similar apertures are provided adjacent to the upper end of each extension tube 50, so that the apertures in the hub of each additional carousel may be aligned with or offset from the apertures in the associated extension tube to allow or prevent air flow from the boot supports of that carousel.

Although carousels 13, 14, 15, etc. may be identical, in the preferred embodiment of the invention each carousel is different in diameter, and the boot pads 41 are of different sizes. It is preferred that carousel 13 be of the largest diameter, carousel 14 be of a smaller diameter than carousel 13, and that carousel 15 be of a smaller diameter than carousel 14, so that boots placed on successive carousels are positioned at a different distance from the center axis of the rack structure and are not suspended directly over each other. It is also preferred that the length of the boot pads of carousel 13 be selected to accommodate high, e.g., over the knee, boots; the length of the boot pads of carousel 14 be selected to accommodate shorter, e.g., calfheight boots; and the length of the boot pads of carousel 15 be selected to accommodate, e.g., ankle height boots. The length of the extension tubes may also be varied accordingly. Variation in the length of the boot pads and in the spacing of the carousels ensures that the appropriate support is provided for the type of boots to be stored, and also achieves efficient utilization of storage space. Variation in the structure of carousels available within the scope of the invention also allows each user to select carousels best suited to his or her collection of boots, and to change carousels if the composition of the collection changes.

Further structural variations may also be made within the scope of the invention. In one alternative embodiment the length of the legs of the boot supports from the base of the boot support is adjustable. Hollow, open ended end tubes 56 may be disposed over the open first and second ends of the legs of boot supports 37 in telescoping relation, so that the height at which air is emitted may be adjusted by sliding the end tubes up and down on the boot support tubes.

Although in the description of the preferred embodiment blower 20, heating unit 21, and ionizing unit 23 are described as being powered by household electrical power, it is contemplated that the rack of the invention will often be placed in a closet where access to an electrical outlet is not readily available. In an alternative embodiment the blower, heating unit, and ionizing unit are powered by direct current from a battery pack 57, preferably disposed in base 11. Battery pack 57 may include a single, large capacity battery unit, or a plurality of individual batteries, and the battery or batteries are preferably rechargeable. The battery pack may be removable from the base of the rack as a unit and plugged into a recharging unit (not shown) for recharging between uses, and then easily inserted into the base to provide power when needed. Alternatively, if the battery pack is comprised of individual batteries, the batteries themselves may be removable from a battery holder in the base for recharging in a conventional recharging unit and then returned to the battery holder for use.

In another variation a timer 58 may be added to the electrical circuit, so that the blower, with or without heat and\or ionization, will be provided for a selected period of time and then automatically deactivated, eliminating the need for a user to remember to manually turn off the power and preventing the potential problem of excessive drying.

The boot rack of the invention provides efficient storage for multiple pairs of boots, protecting the boots from damage while making them readily available to a user. Boots may be easily selected and removed from the rack for use, and easily returned to the rack for storage. The boot rack of the invention allows selected boots or all boots stored to be dried with warn air, with or without ionization, and also allows unheated air, with or without ionization, to be selectively circulated through stored boots to keep them fresh and free of odors.

The foregoing description of preferred and alternative embodiments is intended to be illustrative and not limiting. The boot rack of the invention is susceptible to additional variations and alternative embodiments, all within the scope of the invention and the scope of the following claims.

The invention claimed is:

1. An apparatus for storing and conditioning boots having a foot portion and a leg portion, comprising, a base having a bottom wall and a housing connected to said bottom wall, said housing defining and surrounding a hollow interior of said base, said housing having an air inlet for the flow of air into said hollow interior of said base, and said housing having a central aperture for the exit of air from said base;

a hollow primary support and duct tube having an open first end and an open second end, said primary tube connected at said first end to said housing in air flow communication with said central aperture in said housing and extending outwardly from said housing generally perpendicular to said bottom wall of said base;

a blower unit disposed in said hollow interior of said base so as to draw air into said blower through said air inlet of said housing and expel air from said blower within said hollow interior of said base and into said primary tube upon activation of said blower unit;

a heating unit disposed in said hollow interior of said base in air flow communication with said blower and said primary tube so as to heat air expelled from said blower into said primary tube upon activation of said heating unit;

a boot carousel having a hollow hub with a side wall, an open first end and an open second end, said first end of said hub received over said second end of said primary tube in air flow communication with said primary tube, said hub having a plurality of apertures penetrating said side wall, a plurality of elongate hollow tubular spokes equal in number to said apertures, each of said spokes having an open first end and an open second end, and each of said spokes connected at said first end there of to said hub at a respective one of said apertures in air flow communication with said hub through said aperture, a plurality of generally U-shaped hollow tubular boot supports equal in number to said spokes, each having a first end and a second end and an aperture penetrating said boot support between said first and second ends, each said boot support connected to a respective one of said spokes in air flow communication therewith through said aperture of said boot support, each of said boot supports to receive and support a pair of boots with said open first end of said boot support disposed in the leg portion of one of the boots of the pair and with said open second end of said boot support disposed in the leg of the other of the boots such that air is expelled into each of the boots upon activation of said blower unit; and a cap, removably connected to said second end of said hub of said carousel for closing said second end of said hub against the flow of air therethrough upon activation of said blower unit.

2. The apparatus of claim 1, wherein said boot carousel further includes a first pair of boot pads connected in opposing relation to each of said boot supports at said first end thereof and a second pair of boot pads connected in opposing relation to each of said boot support at said second end thereof, each pair of said boot pads to be received in the leg portion of a boot to provide support for the leg portion of the boot.

3. The apparatus of claim 2, wherein each of said boot pads is connected to said boot support by a resilient mounting rod such that said boot pad is movable toward said boot support in response to force exerted by the placement of a boot leg over each pair of said boot pads.

4. The apparatus of claim 3, wherein each of said mounting rods comprises a pair of telescoping rods with a hollow interior, and a coil spring disposed in said interior of said telescoping rods.

5. The apparatus of claim 1, wherein said blower and said heating unit are electrically powered from a source of electrical power, and wherein said base further includes a blower switch operatively connected between said blower and said source of electrical power for activating and deactivating said blower, and a heating unit switch operatively connected between said heating unit and said source of electrical power for activating and deactivating said heating unit.

6. The apparatus of claim 5, wherein said blower is a variable speed blower and said blower switch has selectable blower speed settings, and wherein said heating unit is switchable between a high heat setting and a low heat setting and said heating unit switch has a high setting and a low setting.

7. The apparatus of claim 1, further comprising an ionizing unit disposed in said hollow interior of said base in air flow communication with said blower, said heating unit, and said primary tube so as to ionize air expelled from said blower into said primary tube upon activation of said ionizing unit.

8. The Apparatus of claim 7, wherein said blower, said heating unit, and said ionizing unit are electrically powered from a source of electrical power, and wherein said base further includes a blower switch operatively connected between said blower and said source of electrical power for activating and deactivating said blower, a heating unit switch operatively connected between said heating unit and said source of electrical power for activating and deactivating said heating unit, and an ionizing unit switch operatively connected between said ionizing unit and said source of electrical power for activating and deactivating said ionizing unit.

9. The apparatus of claim 7, further comprising an air duct interconnecting said blower unit, said heating unit, said ionizing unit, and said primary tube so as to form an air flow passageway from said blower, through said heating, through said ionizing unit, and to said primary tube.

10. The apparatus of claim 1, further comprising an air duct interconnecting said blower unit, said heating unit, and said primary tube so as to form an air flow passageway from said blower unit through said heating unit and to said primary tube.

11. The apparatus of claim 1, wherein said carousel further includes an air flow control valve disposed in each of said spokes between said first and second ends thereof for controlling the flow of air through said spokes upon activation of said blower unit.

12. The apparatus of claim 1, wherein said primary tube includes a plurality of apertures adjacent to said second end thereof, wherein said carousel is rotatable relative to said primary tube such that said carousel may be rotated on said primary tube to align said apertures in said primary tube with said apertures in said hub so as to allow air flow from said primary tube into said spokes when said apertures in said hub are aligned with said apertures in said hub, and to prevent air flow from said primary tube into said spokes when said apertures in said hub are not aligned with said apertures in said hub.

13. The apparatus of claim 1, wherein said boot carousel further includes an annular stabilizing ring disposed concentric with said hub and connected to said spokes adjacent to said second end of each of said spokes such that said stabilizing ring does not interfere with the flow of air through said spokes.

14. The apparatus of claim 1, further comprising, a hollow extension tube having an open first end and an open second end, said extension tube connected at said first end to said hub of said carousel and extending outwardly therefrom in coaxial alignment with said primary tube;

a second boot carousel having a hollow second hub with a side wall, an open first end and an open second end, said first end of said second hub received over said second end of said extension tube in air flow communication with said extension tube, said second hub having a plurality of apertures penetrating said side wall, a plurality of elongate hollow tubular second spokes equal in number to said apertures, each of said second spokes having an open first end and an open second end, and each of said second spokes connected at said first end there of to said second hub at a respective one of said apertures in air flow communication with said second hub through said aperture, a plurality of generally U-shaped hollow tubular second boot supports equal in number to said second spokes, each having a first end and a second end and an aperture penetrating said second boot support between said first and second ends, each said second boot support connected to a respective one of said second spokes in air flow communication therewith through said aperture of said second boot support, each of said second boot supports to receive and support a pair of boots with said open first end of said second boot support disposed in the leg portion of one of the boots of the pair and with said open second end of said second boot support disposed in the leg of the other of the boots such that air is expelled into each of the boots upon activation of said blower unit; and wherein said cap is removably connected to said second end of said second hub.

15. The apparatus of claim 14, further comprising, a hollow second extension tube having an open first end and an open second end, said second extension tube connected at said first end to said hub of said second carousel and extending outwardly therefrom in coaxial alignment with said primary tube;

a third boot carousel having a hollow third hub with a side wall, an open first end and an open second end, said first end of said third hub received over said second end of said second extension tube in air flow communication with said second extension tube, said third hub having a plurality of apertures penetrating said side wall, a plurality of elongate hollow tubular third spokes equal in number to said apertures, each of said third spokes having an open first end and an open second end, and each of said third spokes connected at said first end there of to said third hub at a respective one of said apertures in air flow communication with said third hub through said aperture, a plurality of generally U-shaped hollow tubular third boot supports equal in number to said third spokes, each having a first end and a second end and an aperture penetrating said third boot support between said first and second ends, each said third boot support connected to a respective one of said third spokes in air flow communication therewith through said aperture of said third boot support, each of said third boot supports to receive and support a pair of boots with said open first end of said third boot support disposed in the leg portion of one of the boots of the pair and with said open second end of said third boot support disposed in the leg of the other of the boots such that air is expelled into each of the boots upon activation of said blower unit; and wherein said cap is removably connected to said second end of said third hub.

16. An apparatus for storing and conditioning boots having a foot portion and a leg portion, comprising, a base having a bottom wall and a housing connected to said bottom wall, said housing defining and surrounding a hollow interior of said base, said housing having an air inlet for the flow of air into said hollow interior of said base, and said housing having a central aperture for the exit of air from said base;

a hollow primary support and duct tube having an open first end and an open second end, said primary tube connected at said first end to said housing in air flow communication with said central aperture in said housing and extending outwardly from said housing generally perpendicular to said bottom wall of said base;

a blower unit disposed in said hollow interior of said base so as to draw air into said blower through said air inlet of said housing and expel air from said blower within said hollow interior of said base and into said primary tube upon activation of said blower unit;

a heating unit disposed in said hollow interior of said base in air flow communication with said blower and said primary tube so as to heat air expelled from said blower into said primary tube upon activation of said heating unit;

a boot carousel having a hollow hub with a side wall, an open first end and an open second end, said first end of said hub received over said second end of said primary tube in air flow communication with said primary tube, said hub having a plurality of apertures penetrating said side wall, a plurality of elongate hollow tubular spokes equal in number to said apertures, each of said spokes having an open first end and an open second end, and each of said spokes connected at said first end there of to said hub at a respective one of said apertures in air flow communication with said hub through said aperture, air flow control means for selectively opening and closing said spokes to the flow of air therethrough, an annular stabilizer ring disposed concentric with said hub and connected to each of said spokes adjacent to said second end of each of said spokes, a plurality of generally U-shaped hollow tubular boot supports equal in number to said spokes, each having a first end and a second end and an aperture penetrating said boot support approximately midway between said first and second ends, each said boot support connected to a respective one of said spokes and extending therefrom away from said base, each said boot support in air flow communication with said respective one of said spokes through said aperture of said boot support, each of said boot supports to receive and support a pair of boots in inverted orientation relative to said bottom wall of said base with said open first end of said boot support disposed in the leg portion of one of the boots of the pair and with said open second end of said boot support disposed in the leg of the other of the boots of the pair such that air may be expelled into each of the boots upon activation of said blower unit; and a cap, removably connected to said second end of said hub of said boot carousel for closing said second end of said hub against the flow of air therethrough upon activation of said blower unit.

17. The apparatus of claim 16, wherein said boot carousel further includes a first pair of boot pads connected in opposing relation to each of said boot supports at said first end thereof and a second pair of boot pads connected in opposing relation to each of said boot support at said second end thereof, each pair of said boot pads to be received in the leg portion of a boot to provide support for the leg portion of the boot.

18. The apparatus of claim 16, wherein each of said boot supports of said boot carousel further includes a first hollow open ended end tube disposed over said first end of said boot support in telescoping relation therewith, and a second hollow open ended end tube disposed over said second end of said boot support in telescoping relation therewith.

19. The apparatus of claim 16, wherein said air flow control means of said carousel comprises an air flow control valve disposed in each of said spokes between said first and second ends thereof.

20. The apparatus of claim 16, wherein said carousel is rotatable relative to said primary tube, and wherein said air flow control means of said carousel comprises a plurality of apertures penetrating said primary tube adjacent to said second end thereof, each of said apertures in said primary tube alignable with one of said apertures in said hub by rotation of said carousel on said primary tube such that said carousel may be rotated on said primary tube so as to bring said apertures in said primary tube into alignment with said apertures in said hub to allow air flow from said primary tube into and through said spokes, and said carousel may be rotated on said primary tube so as to bring said apertures in said primary tube out of alignment with said apertures in said hub to prevent air flow from said primary tube into said spokes.

21. The apparatus of claim 16, further comprising, a hollow extension tube having an open first end and an open second end, said extension tube connected at said first end to said hub of said carousel and extending outwardly therefrom in coaxial alignment with said primary tube;

a second boot carousel having a hollow second hub with a side wall, an open first end and an open second end, said first end of said second hub received over said second end of said extension tube in air flow communication with said extension tube, said second hub having a plurality of apertures penetrating said side wall, a plurality of elongate hollow tubular second spokes equal in number to said apertures, each of said second spokes having an open first end and an open second end, and each of said second spokes connected at said first end there of to said second hub at a respective one of said apertures in air flow communication with said second hub through said aperture, second air flow control means for selectively opening and closing said second spokes to the flow of air therethrough, a second annular stabilizer ring disposed concentric with said second hub and connected to each of said second spokes adjacent to said second end of each of said second spokes, a plurality of generally U-shaped hollow tubular second boot supports equal in number to said second spokes, each having a first end and a second end and an aperture penetrating said second boot support approximately midway between said first and second ends, each said second boot support connected to a respective one of said second spokes and extending therefrom away from said base, each said second boot support in air flow communication with said respective one of said second spokes through said aperture of said second boot support, each of said second boot supports to receive and support a pair of boots in inverted orientation relative to said bottom wall of said base with said open first end of said second boot support disposed in the leg portion of one of the boots of the pair and with said open second end of said second boot support disposed in the leg of the other of the boots of the pair such that air may be expelled into each of the boots upon activation of said blower unit;

a hollow second extension tube having an open first end and an open second end, said second extension tube connected at said first end to said hub of said second carousel and extending outwardly therefrom in coaxial alignment with said primary tube;

a third boot carousel having a hollow third hub with a side wall, an open first end and an open second end, said first end of said third hub received over said second end of said second extension tube in air flow communication with said extension tube, said third hub having a plurality of apertures penetrating said side wall, a plurality of elongate hollow tubular third spokes equal in number to said apertures, each of said third spokes having an open first end and an open second end, and each of said third spokes connected at said first end there of to said third hub at a respective one of said apertures in air flow communication with said third hub through said aperture, third air flow control means for selectively opening and closing said third spokes to the flow of air therethrough, a third annular stabilizer ring disposed concentric with said third hub and connected to each of said third spokes adjacent to said second end of each of said third spokes, a plurality of generally U-shaped hollow tubular third boot supports equal in number to said third spokes, each having a first end and a second end and an aperture penetrating said third boot support approximately midway between said first and second ends, each said third boot support connected to a respective one of said third spokes and extending therefrom away from said base, each said third boot support in air flow communication with said respective one of said third spokes through said aperture of said third boot support, each of said third boot supports to receive and support a pair of boots in inverted orientation relative to said bottom wall of said base with said open first end of said third boot support disposed in the leg portion of one of the boots of the pair and with said open second end of said third boot support disposed in the leg of the other of the boots of the pair such that air may be expelled into each of the boots upon activation of said blower unit; and wherein said cap is removably connected to said second end of said third hub.

22. The apparatus of claim 16, further comprising an ionizing unit disposed in said hollow interior of said base in air flow communication with said blower, said heating unit, and said primary tube so as to ionize air expelled from said blower into said primary tube upon activation of said ionizing unit.

23. The apparatus of claim 22, wherein said blower, said heating unit, and said ionizing unit are electrically powered from a source of electrical power, and wherein said base further includes a blower switch operatively connected between said blower and said source of electrical power for activating and deactivating said blower, a heating unit switch operatively connected between said heating unit and said source of electrical power for activating and deactivating said heating unit, and an ionizing unit switch operatively connected between said ionizing unit and said source of electrical power for activating and deactivating said ionizing unit.

24. The apparatus of claim 23, wherein said base further includes a master switch operatively connected between said source of electrical power and said blower switch, said heating unit switch, and said ionizing unit switch for selectively connecting said switches to said source of electrical power and disconnecting said switches from said source of electrical power.

25. The apparatus of claim 23, wherein said source of electrical power is a battery.

* * * * *